US006331767B1

(12) United States Patent
Davies

(10) Patent No.: US 6,331,767 B1
(45) Date of Patent: Dec. 18, 2001

(54) POWER SUPPLIES OF ECUS

(75) Inventor: Gary Raymond Davies, Rugby (GB)

(73) Assignee: Lucas Industries, plc, London (GB)

( * ) Notice: Subject to any disclaimer, the term of this patent is extended or adjusted under 35 U.S.C. 154(b) by 0 days.

(21) Appl. No.: 09/643,270

(22) Filed: Aug. 22, 2000

(30) Foreign Application Priority Data

Feb. 24, 1998 (GB) ..... 9803723
Jan. 29, 1999 (WO) ..... PCT/GB99/00322

(51) Int. Cl.[7] ..... G05F 1/40
(52) U.S. Cl. ..... 323/282
(58) Field of Search ..... 323/273, 282, 323/284, 303, 351

(56) References Cited

U.S. PATENT DOCUMENTS 3,641,424 * 2/1972 Kuykendall ..... 323/286
3,947,752 * 3/1976 Morgan ..... 323/284
3,968,421 * 7/1976 Marcade ..... 323/303
4,319,179 * 3/1982 Jett, Jr. ..... 323/281
4,593,338 6/1986 Takeda et al. .
6,137,276 * 10/2000 Rudolph ..... 323/282

FOREIGN PATENT DOCUMENTS 41 10 495 A1 10/1992 (DE) .
0 632 562 A2 1/1995 (EP) .

OTHER PUBLICATIONS

Patent Abstracts of Japan, vol. 004, No. 163, Aug. 30, 1980, JP 55 112618 A.

* cited by examiner

*Primary Examiner*—Adolf Deneke Berhane
(74) *Attorney, Agent, or Firm*—MacMillan, Sobanski & Todd, LLC

(57) ABSTRACT

A voltage supply circuit for an ECU of the type in which a supply voltage is connected to a voltage regulator via an N-MOSFET control device, wherein, at least above a predetermined lower operating value, the control device is adapted to introduce resistance of progressively higher value between the voltage supply and the voltage regulator in dependence upon increasing values of supply voltage.

9 Claims, 1 Drawing Sheet

POWER SUPPLIES OF ECUS

CROSS REFERENCE TO RELATED APPLICATIONS

This application claims the benefit of International Application No. PCT/GB99/00322, filed Jan. 29, 1999, and United Kingdom Patent Application No. GB9803723.7 filed on Feb. 24, 1998.

The present invention relates to power supplies for microprocessors acting as electronic control units/controllers (ECUs) in vehicles and is concerned principally with "Load Dump" protection and on/off control of such devices.

Automotive controllers must be able to withstand without damage, high energy transients on the controllers $B^+$ supply, referred to as "Load Dump". It is often desired to have the controller fully functional during a "Load Dump". Most voltage regulators have some form of built-in "Load Dump" protection which may involve having the voltage regulator shut down during such a "Load Dump". Thus, it is a requirement that the controller must not be damaged by a "Load Dump". Also, the controller may have to operate and be fully functional, during a "Load Dump".

The voltage regulator in the controller may have to operate up to an ambient temperature of +125° C. The power dissipated in the regulator is equal to (Supply Voltage−Output Voltage) Pass Current. When the vehicle has a defective alternator, or during a heavy charging, the $B^+$ voltage could be as high as 18 V. During boost starting, the battery voltage may be as high as 25 V for 5 minutes. The controller may have to be fully functional during high battery voltages and boost starting. Furthermore, the controller may have to operate down to a low battery voltage during engine cranking. To achieve the lowest operating voltage, any component prior to the voltage regulator must impose as small a voltage drop as possible, in order to extend the controllers operating voltage, as much as possible.

The controller may be connected to the vehicle's $B^+$ supply at all times but be enabled remotely. When the device is enabled remotely, the controller may then hold on after the remote enable control signal becomes non active. The controller must have a very low quiescent when not active.

Figure 1:
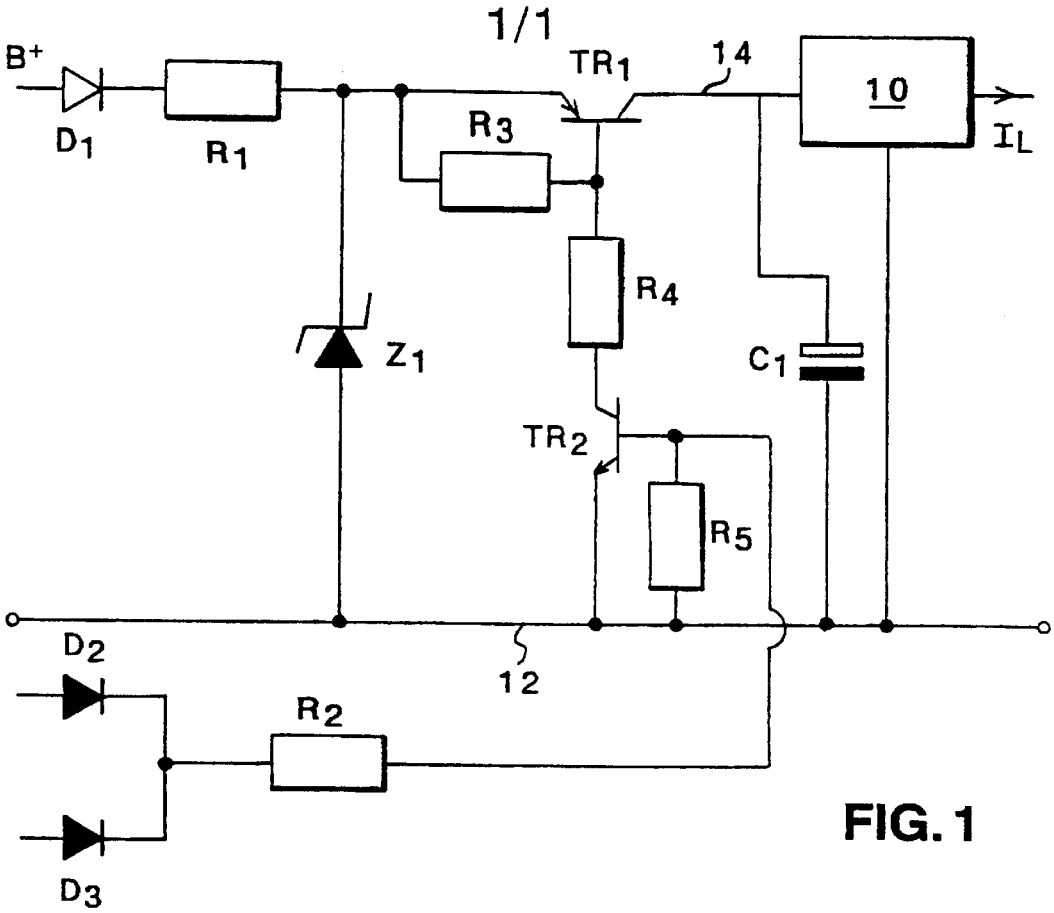

Conventional circuitry for providing the aforegoing "Load Dump" function comprises a series resistor in the $B^+$ line upstream of the regulator and a Zener diode in parallel with the regulator input. An example of such a circuit is shown in FIG. 1 of the attached drawings. FIG. 1 shows a voltage regulator 10 coupled to a voltage supply $B^+$ by way of a diode $D_1$ and resistor $R_1$, with a Zener diode $Z_1$ and an electrolytic capacitor $C_1$ both connected between the regulator input and the other supply line 12.

For allowing remote switching on and off of the voltage regulator, this circuit also includes a switching transistor $Tr_1$ in the regulator input line 14 which can be controlled by way of a second transistor $Tr_2$ by means of enabling signals introduced via respective diodes $D_2$ and $D_3$. The switching levels are controlled by means of resistors $R_3$, $R_4$ and $R_5$.

Using this known circuit, reverse voltages are blocked by the diode $D_1$. Over-voltage transients are absorbed by the combination of $R_1$ and $D_1$. $Tr_1$ and $Tr_2$ constitute a high side switch which enables the voltage regulator to be selectively connected to the $B^+$ supply. The capacitor $C_1$ stores charge such as to enable the voltage regulator to continue working during negative spikes and during temporary interruptions in the $B^+$ supply.

The value of resistor $R_1$ is selected to stop excessive current flowing through and damaging the Zener diode $Z_1$.

The value of resistor $R_1$ will give a voltage drop that will impair the low operating performance of the controller. The latter problem is typically worse when the load current is normally high. The rated voltage of the capacitor must be at least the maximum clamp voltage of the Zener diode $Z_1$.

This known circuit has the disadvantages that:

a) $R_1$ impedes low voltage working operation b) If $Z_1$ is damaged (open circuit), the controller's operation is impaired and the voltage regulator may shut down or be over-stressed.

c) $Z_1$ is a redundant operation component during normal operation.

d) The rated working voltage of $C_1$ should be the clamp voltage of $Z_1$; this can result in $C_1$ having a physically large component size.

e) The voltage regulator will always see the battery voltage $B^+$ when the circuit is on; this can cause excessive heat dissipation in the voltage regulator junction.

From DE-A-4110495 there is known a semiconductor electronic circuit having a protection device for protecting against supply voltage overloading. By means of a first Zener diode, a supply voltage is pre-regulated by a nonlinear resistance. If a load-dump voltage occurs on the voltage supply line, the current through the nonlinear resistance is blocked, by the use of a second Zener diode which becomes conductive if the voltage exceeds an operating value, whereby a further transistor also becomes conductive and the control current at the base electrode of transistor is reduced. Eventually, non-linear resistances reaches a non-conductive state.

From JP-A-55112618 it is known to use an N-MOSFET whose gate is arranged to be held at a substantially fixed potential and whose drain and source are connected between the source and the load. When the power supply voltage increases and the drain current is going to increase, the gate potential is lowered to the source potential, the increase in the drain current is restricted, and the voltage fed to the load is not increased.

EP-A-0632562 is not concerned with overload protection but rather with a voltage regulator circuit which includes a variable impedance. A regulator circuit supplies a regulated low, DC voltage that is derived from an unregulated voltage provided by a pair of redundant batteries. The regulator circuit comprises regulation control that responds to a feedback signal developed from monitoring the regulated voltage to maintain the regulated voltage at a desired level. Battery monitors supervise the voltage levels of the batteries used, and shut down the regulator when the battery voltages drop below a predetermined voltage level to preserve battery life.

SUMMARY OF THE INVENTION

This invention relates to over voltage protection and on/off control of power supplies for microprocessors operating as Electronic Control Units or Controllers.

There is therefore a need for a circuit by which the physical size of the capacitor could be smaller for a given performance. As described above, know methods for maintaining ECU operation typically require a physically large capacitor. There is therefore a need for a circuit by which the physical size of the capacitor could be smaller for a given performance.

In accordance with the present invention, there is provided a voltage supply circuit for an ECU of the type in which a supply voltage is connected to a voltage regulator via a control device, wherein, at least above a predetermined lower operating value, the control device is adapted to introduce resistance of progressively higher value between the voltage supply and the voltage regulator in dependence upon increasing values of supply voltage characterised in that the control device is arranged to disconnect the voltage regulator from the supply until activated by a remote enabling signal, the control device comprises an N-MOSFET whose gate is arranged to be held at a substantially fixed potential and whose drain and source are connected between the supply and the voltage regulator, the substantially fixed potential on the gate of the N-MOSFET is achieved by means of a charge pump and a Zener, and the charge pump is adapted to be remotely enabled but is also energisable via a connection to the supply line, downstream of the N-MOSFET.

Thus, at least above a predetermined lower operating level, eg 7 volts, the resistance introduced between the $B^+$ supply and the voltage regulator increases as the value of the $B^+$ supply voltage increases.

Advantageously, the enabling signal for the charge pump is also arranged to be provided to the gate of the N-MOSFET for initial powering up purposes.

Various objects and advantages of this invention will become apparent to those skilled in the art from the following detailed description of the preferred embodiment, when read in light of the accompanying drawings.

Figure 2:
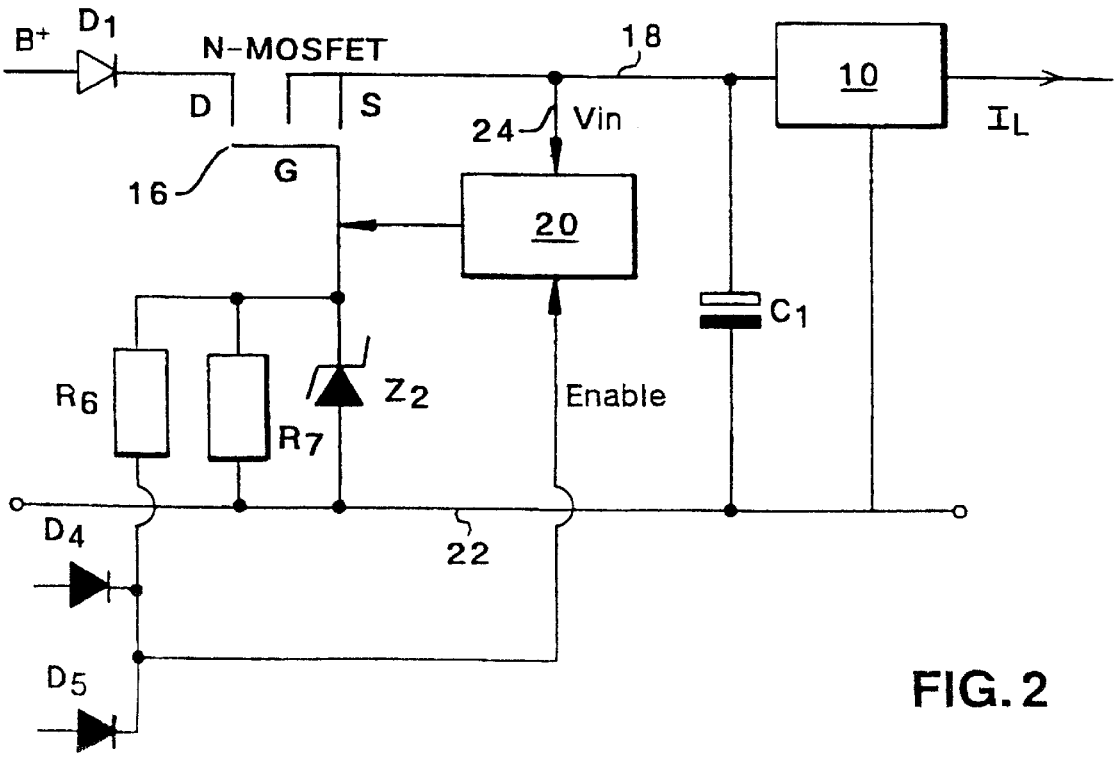

FIG. 1 is a circuit diagram of a known arrangement providing an ON/OFF function and "Load Dump" dissipation; and FIG. 2 is a circuit diagram of one embodiment of a circuit in accordance with the present invention.

DETAILED DESCRIPTION OF THE PREFERRED EMBODIMENT

Referring to FIG. 2, the embodiment in accordance with the present invention comprises a voltage regulator 10 which is coupled to a vehicle $B_+$supply via a diode $D_1$, and an N-MOSFET 16 source follower, whose source S is connected to the input line 18 to the voltage regulator 10 and whose drain D is connect ed to the diode $D_1$. The gate G of the N-MOSFET 16 is connected firstly to the output of a charge pump 20, secondly to the other supply line 22 by the parallel connection of a zener diode $Z_1$ is and a resistor $R_7$ and thirdly to a pair of enabling diodes $D_4$ and $D_5$ by way of a resistor $R_6$. The diodes $D_4$ and $D_5$ are also connected to an enable input of the charge pump 20, the latter charge pump 20 having a power supply line 24 connected to the regulator input line 18. As before, an electrolytic capacitor $C_1$ is placed between the rails 18,22. This circuit operates as follows.

Whenever the voltage Vs at the source of the N-MOSFET is less than the voltage $V_G$ on its gate, the N-MOSFET will conduct. Otherwise, it is non-conductive and effectively provides a high resistance. Thus, when the N-MOSFET is non-conductive, the voltage on the line 18 is held low and the voltage regulator is OFF and supplies no current to the ECU disposed downstream (not shown).

For powering up, an enable signal (normally battery voltage $B^+$) is applied to one of the enable diodes $D_4$, $D_5$. This raises the voltage at the gate of the N-MOSFET to battery voltage so that it is then at a higher voltage than the source Vs. Thus enables the N-MOSFET to start conducting. The enable signal is also applied to the charge pump and this results in the charge pump rapidly increasing the gate voltage $V_G$ up to 12v, thus switching the MOSFET further ON so that it acts as a PRE- voltage regulator.

Once the MOSFET has begun to conduct, the voltage on line 18 rises, supplying an energising voltage for the charge pump 20 via line 24 which, in the case of enabling pulses, maintains its operation when the enabling signal pulse has ended. The gate voltage $V_G$ is then maintained at a fixed potential by virtue of the charge pump and the zener $Z_2$. The voltage at the source 5 is typically 2v less than the voltage on the gate. Whenever the supply voltage is less than the gate voltage, the N-MOSFET becomes more enhanced until it is fully ON (conductive) when typically the battery voltage is about 7 volts (or below). When the MOSFET is fully on, the voltage drop prior to the voltage regulator is at a minimum. However, as the battery voltage rises (for whatever reason), the MOSFET becomes progressively more resistive since the condition that Vs is less that $V_G$ eventually no longer applies. "Load Dump" energy, which in the conventional circuitry would be absorbed in the voltage regulator junction, is then absorbed in the MOSFET junction. The result of this operation is that as $B^+$ rises above its normal level, the MOSFET becomes progressively more resistive such as to hold Vs at a substantially fixed voltage, typically of the order of 10 v.

The above described circuit of FIG. 2 thus provides the functions of:

a) switching the controller ON/OFF;

b) providing "Load Dump" protection upstream of the voltage regulator;

c) extending the operational voltage range of the controller; and d) providing PRE-regulation to minimise heat dissipated in the voltage regulator.

Furthermore, the circuit of FIG. 2 enables the following advantages to be obtained, namely:

1. The rated voltage of capacitor C can be lower, significantly improving the use of available stored energy potential of capacitor C.
2. The power normally dissipated in the Voltage Regulator junction is reduced because of PRE-Voltage Regulating function absorbs energy that would be dissipated in the voltage regulator junction.
3. A wider selection of voltage regulators can be used.
4. The controller can operate down to a lower supply voltage.
5. The controller can operate up to a higher voltage.
6. The controller is fully functional during a load dump, and boost start condition.
7. The controller has significant thermal advantages.
8. The operation of the "Load Dump" protection can be tested.
9. The clamping voltage of a "Load Dump" is the same as the PRE-regulator voltage.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An input circuit for a voltage regulator comprising:

a control device having an input terminal and an output terminal, said control device responsive to an enabling signal applied to said input terminal to generate a control voltage at said output terminal;

a n-channel MOSFET having a gate terminal connected to said output terminal of said control device, said MOSFET also having a drain terminal adapted to be connected to a power supply and a source terminal adapted to be connected to a voltage regulator input terminal, said MOSFET being initially in a non-conductive state to prevent current from flowing from said power supply to said voltage regulator and said MOSFET being responsive to said control voltage to change to a conducting state to allow an electric current to flow between said drain and source terminals; and a zener diode having an anode and a cathode, said anode being connected to said gate terminal of said MOSFET to limit said control voltage such that said MOSFET progressively reduces the current flowing between said drain and source terminals when the power supply voltage increases above a predetermined level.

2. The input circuit according to claim 1 wherein said MOSFET also progressively increases the current flowing between said drain and source terminals when the power supply voltage decreases toward said predetermined level.

3. The input circuit according to claim 1 wherein said control device includes a charge pump.

4. The input circuit according to claim 3 wherein said enabling signal is a pulse which initially causes said charge pump to generate said control voltage and further wherein said charge pump also has an input terminal which is connected to said source terminal of said MOSFET, such that the voltage at said MOSFET source terminal causes said charge pump to continue to generate said control voltage after said enabling pulse ends.

5. The input circuit according to claim 4 wherein said enabling signal is also applied to said gate terminal of said MOSFET.

6. The input circuit according to claim 5 further including a capacitor connected between said MOSFET source terminal and said zener diode cathode.

7. The input circuit according to claim 6 further including a diode having an anode and a cathode, said diode cathode being connected to said drain terminal of said MOSFET and said diode cathode being adapted to be connected to said power supply.

8. The input circuit according to claim 7 further including a resistor connected between said anode and said cathode of said zener diode.

9. The input circuit according to claim 8 wherein said diode is a first diode and further including a resistor having first and second ends, said first end of said resistor connected to said MOSFET gate terminal and said second end of said resistor connected to an anode of a second diode, said second diode also having a cathode adapted to be connected to a source of said enabling signal.

* * * * *

UNITED STATES PATENT AND TRADEMARK OFFICE

CERTIFICATE OF CORRECTION

PATENT NO. : 6,331,767 B1
DATED : December 18, 2001
INVENTOR(S) : Garry R. Davies It is certified that error appears in the above-identified patent and that said Letters Patent is hereby corrected as shown below:

Title page, Item [54] and Column 1, line 1,
Please change the title from "POWER SUPPLIES FOR ECUS" to -- POWER SUPPLIES FOR ECUs --.

Item [75], please change the "Inventor, Gary Raymond Davies" to -- Garry Raymond Davies --.

Signed and Sealed this

Twenty-sixth Day of November, 2002

*Attest:*

*Attesting Officer*

JAMES E. ROGAN
*Director of the United States Patent and Trademark Office*